US009536686B2

(12) United States Patent
Haraguchi

(10) Patent No.: US 9,536,686 B2
(45) Date of Patent: Jan. 3, 2017

(54) COVER FOR SWITCH TO WHICH A FRAME IS ATTACHABLE AND AN OPERATION TERMINAL

(71) Applicant: PANASONIC INTELLECTUAL PROPERTY MANAGEMENT CO., LTD., Osaka (JP)

(72) Inventor: Taku Haraguchi, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/639,039

(22) Filed: Mar. 4, 2015

(65) Prior Publication Data

US 2015/0262766 A1 Sep. 17, 2015

(30) Foreign Application Priority Data

Mar. 13, 2014 (JP) ..... 2014-049992

(51) Int. Cl.
*H01H 9/02* (2006.01)
*H02G 3/14* (2006.01)

(52) U.S. Cl.
CPC ..... *H01H 9/02* (2013.01); *H01H 2223/02* (2013.01); *H01H 2223/044* (2013.01)

(58) Field of Classification Search
CPC .. H01H 9/02; H01H 2223/02; H01H 2223/04; H02G 3/08; H02G 3/081; H02G 3/14
USPC ..... 174/53, 66, 67; 220/241, 242; 439/536
See application file for complete search history.

(56) References Cited

U.S. PATENT DOCUMENTS 5,189,259 A * 2/1993 Carson ..... H02G 3/14 174/57
5,723,817 A * 3/1998 Arenas ..... H02G 3/14 174/66
7,456,358 B2 * 11/2008 Swiencicki ..... H02G 3/14 174/66

(Continued)

FOREIGN PATENT DOCUMENTS

CN 203242831 U 10/2013
JP 02-035852 A 2/1990

(Continued)

OTHER PUBLICATIONS

Taiwanese Search Report dated Dec. 21, 2015 issued in Taiwanese Patent Application No. 104106143.

*Primary Examiner* — Angel R Estrada
(74) *Attorney, Agent, or Firm* — McDermott Will & Emery LLP

(57) ABSTRACT

A cover for switch is capable of mounting a frame thereon. A protruding portion, which protrudes from a mounting surface on which the frame is to be mounted, is provided with switch operation portions in the front face of the protruding portion. A first wall part, a second wall part and a third wall part are provided upright on the mounting surface, and have a first hole, a second hole and a third hole, through which projecting portions provided in the frame are inserted, respectively. A first raised claw and a second raised claw are provided on a protruding side positioned opposite to the first wall part and the third wall part, for the purpose of fastening a decorative cover for covering the switch operation portions.

9 Claims, 17 Drawing Sheets

(56) References Cited

U.S. PATENT DOCUMENTS

| | | | | |
|---|---|---|---|---|
| 7,947,903 | B2 * | 5/2011 | Peck | H02G 3/14 174/50 |
| 8,334,459 | B2 * | 12/2012 | Chaumeny | H02G 3/14 174/66 |
| 9,112,319 | B2 | 8/2015 | Liao et al. | |

FOREIGN PATENT DOCUMENTS

| | | | |
|---|---|---|---|
| JP | 03-252011 | A | 11/1991 |
| JP | 06-299771 | A | 10/1994 |
| JP | H11-008950 | A | 1/1999 |
| JP | 2000-188793 | A | 7/2000 |
| JP | 2000-278777 | A | 10/2000 |
| JP | 2002-245893 | A | 8/2002 |
| JP | 4853351 | B2 | 1/2012 |
| KR | 10-1998-0079832 | A | 11/1998 |
| TW | M347653 | U | 12/2008 |
| TW | M446408 | U | 2/2013 |

* cited by examiner

COVER FOR SWITCH TO WHICH A FRAME IS ATTACHABLE AND AN OPERATION TERMINAL

This application is based upon and claims the benefit of priority from the prior Japanese Patent Application No. 2014-049992, filed on Mar. 13, 2014, the entire contents of which are incorporated herein by reference.

BACKGROUND

1. Field of the Invention

The disclosure relates to a cover for switch, and it particularly relates to a cover for switch, to which a frame is attachable, and an operation terminal.

2. Description of the Related Art

In a remote monitoring control system (see, Japanese Unexamined Patent Application Publication No. 2000-188793, for instance), a plurality of operation terminals and a plurality of control terminals are connected to a transmission processing apparatus via a two-wire signal line using a time division multiple access (TDMA) scheme. The operation terminal is provided with a switch or switches. An interrupt signal generated by the operation of this switch is transmitted to the transmission processing apparatus. Upon receiving the signal via the transmission processing apparatus, a control terminal controls a load in accordance with the operation of the switch. Here, two pairs of stopper claws, which function as mounting means for a mounting frame are provided in a cover of the operation terminal in a protruding manner. These stopper claws allow the cover to be removably mountable to the mounting frame, which is used when the existing wiring devices are embedded in a wall surface. Further, a decorative cover is attached to a front face of the cover.

In order to increase the service life of the operation terminal, it is demanded that the damage to a mounting part of the mounting frame and the cover as well as a mounting part of the decorative cover and the cover be prevented. Adding a structural component for preventing such damages to cope with this increases the overall size of the cover. At the same time, it is undesirable to increase the size of the operation terminal as a result of the increase in the size of the cover.

SUMMARY

The disclosure has been made in view of foregoing circumstances, and a purpose thereof is to provide a technology for suppressing the increase in the size of a cover while the damage to the mounting parts of a frame and a decorative cover is prevented.

In order to resolve the foregoing problems, a cover for switch, according to one embodiment of the disclosure is a cover for switch, to which a frame is mountable, and the cover includes: a protruding portion that protrudes from a mounting surface on which the frame is to be mounted, the protruding portion having a switch operation portion in a front face thereof; and a wall part having a hole through which a projecting portion provided in the frame is inserted, the wall part being provided upright on the mounting surface. A stopper, which fastens a decorative cover for covering the switch operation portion, is provided in a lateral face of the protruding portion disposed counter to the wall part.

Formed are a pair of connection wall parts extending from both ends of the wall part along the lateral face of the protruding portion, and the stopper is surrounded by the wall part and the pair of the connection wall parts.

The stopper may be a raised claw for fastening an elastic piece that is to be fastened, the elastic piece being formed on the decorative cover.

When the projecting portion provided in the frame is inserted into the hole, the stopper is provided in a position shifted from the projecting portion as the cover for switch is viewed from a front thereof.

Another embodiment of the disclosure relates to an operation terminal. The operation terminal may include: a cover for switch; and a body coupled to the cover for switch, the body containing a printed wiring board where a switch body is packaged.

BRIEF DESCRIPTION OF THE DRAWINGS

The figures depict one or more implementations in accordance with the present teaching, by way of example only, not by way of limitations. In the figures, like reference numerals refer to the same or similar elements.

FIGS. 2A to 2C each shows a transmission signal in the remote monitoring control system of FIG. 1;

DETAILED DESCRIPTION

The invention will now be described by reference to the preferred embodiments. This does not intend to limit the scope of the disclosure, but to exemplify the invention.

First Exemplary Embodiment

The inventor's knowledge underlying the disclosure will be explained before a first exemplary embodiment of the disclosure is explained. The first exemplary embodiment of the disclosure relates to a cover for switch or switches of an operation terminal included in a remote monitoring control system. Here, the "cover for switch" may instead be referred to as or expressed by a "cover for a switch", a "cover for switches", a "switch cover", a "switch's cover", "switches' cover" or else, where appropriate. A frame and a decorative cover are mounted to the cover for switch. If the frame is a general-purpose item, the size of the cover for switch will be restricted by the size of the frame. As discussed earlier, in order to increase the service life of the operation terminal, the damage to the mounting part needs to be prevented. The size of the cover for switch increases as a result of adding a structural component for preventing such a damage. Then the frame cannot be mounted. Hence, it is demanded that the mounting part has a function of preventing damage and breakage and is arranged efficiently. Under such a background as described above, the cover for switch according to the present embodiment is constructed and arranged as follows.

Figure 1:
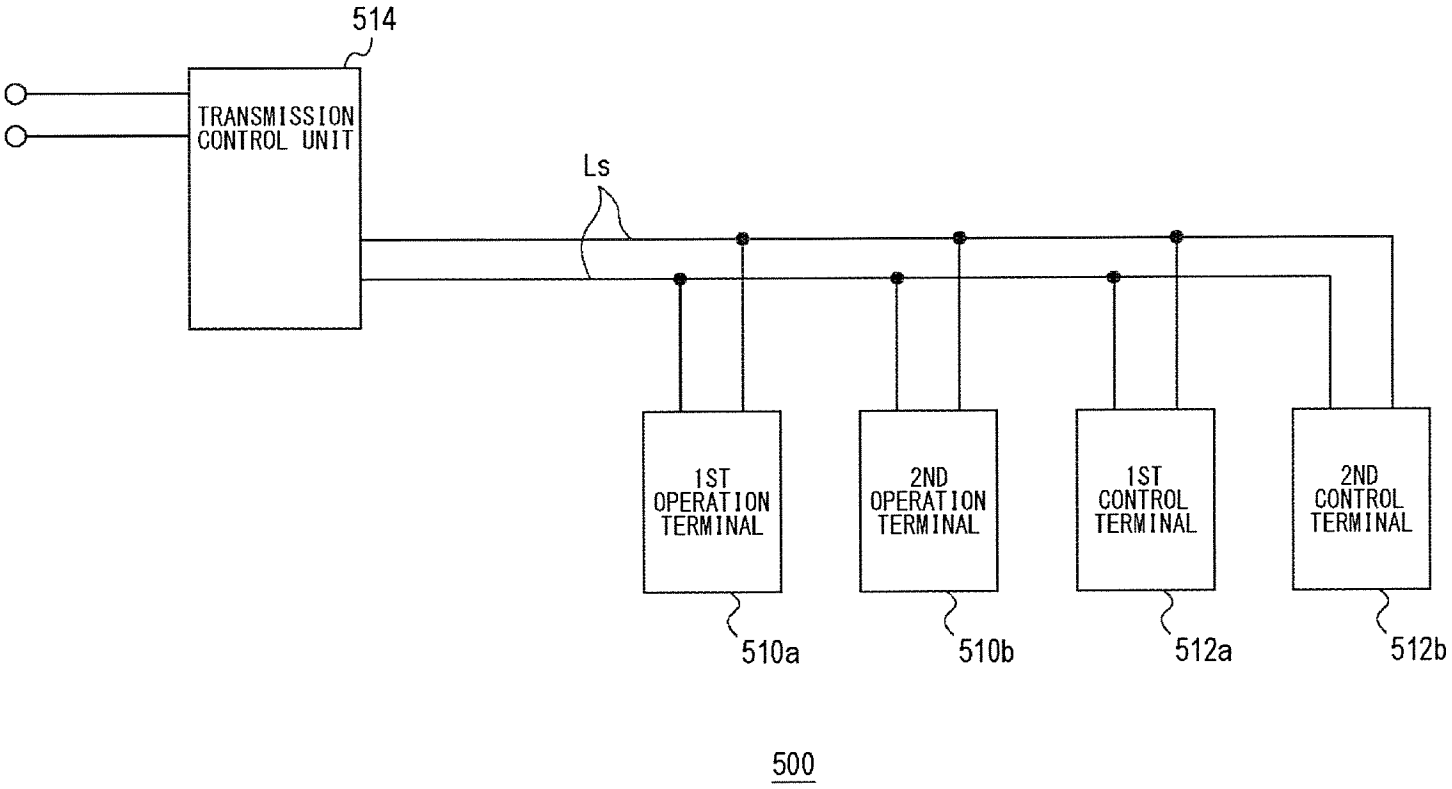
FIG. 1 shows a structure of a remote monitoring control system according to a first exemplary embodiment of the disclosure.

FIG. 1 shows a structure of a remote monitoring control system 500 according to the first exemplary embodiment of the disclosure. The remote monitoring control system 500 includes a first operation terminal 510*a* and a second operation terminal 510*b*, which are generically referred to as "operation terminal 510" or "operation terminals 510", a first control terminal 512*a* and a second control terminal 512*b*, which are generically referred to as "control terminal 512" or "control terminals 512", and a transmission control unit 514. In this example in conjunction with FIG. 1, two operation terminals 510 and two control terminals 512 are included in the remote monitoring control system 500, as a mere example, but the number of them is not limited to "two". The operation terminals 510 and the control terminals 512 are each connected to the transmission control unit 514 through a two-wire signal line Ls.

Each operation terminal 510 has at least one switch, which is pushed and operated by a pushing force applied from a front side of the operation terminal 510. Each control terminal 512 has at least one relay (not shown) inserted in a power feed line connected to a load (not shown), such as a lighting apparatus or a ventilation fan. The on and off of the load is controlled by switching on and off this relay. Specific addresses are assigned to the operation terminals 510, the switch(es) and the relay(s), respectively. The number of usable addresses in the remote monitoring control system 500 is two hundred fifty six (256) addresses in total, for instance, if four circuits, to which the numbers "1" to "4" are allotted, are arranged in sixty four (64) channels, to which the numbers "0" to "63" are allotted. In other words, there are 4 times 64 addresses (i.e., 256 addresses) usable in total. Each address is indicated by "63-3", for instance, if the channel number and the circuit number are combined.

Figure 2A:
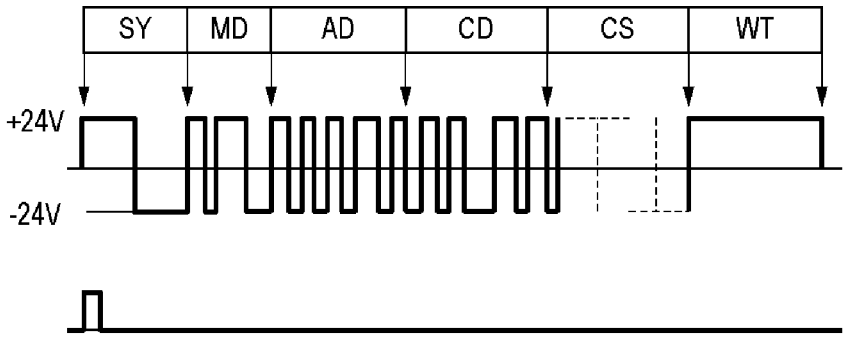

The transmission control unit 514 transmits a transmission signal Vs to the signal line Ls. FIGS. 2A to 2C each shows a transmission signal in the remote monitoring control system 500. Here, FIG. 2A shows formats of the transmission signal Vs. A synchronization signal SY indicative of a signal transmission start, mode data MD indicative of a mode of the transmission signal Vs, address data AD with which to individually call out an operation terminal 510 or a control terminal 512, and control data CD with which to control the load are time-division multiplexed in the transmission signal Vs. Checksum data CS, which is used to detect the transmission errors, and a signal response period WT, which is a time slot for receiving a reply signal (monitoring data) sent from the operation terminal 510 or the control terminal 512, are also time-division multiplexed, in addition to the aforementioned ones, in the transmission signal Vs.

FIG. 2B shows an exemplary waveform of the transmission signal Vs. The transmission signal Vs is a bipolar signal (±24 V) and is produced by a pulse width modulation. If the address data AD transmitted by the transmission signal Vs received via the signal line Ls coincides with a preset address, each operation terminal 510 and each control terminal 512 will take in (retrieve) the control data CD from the transmission signal Vs. Also, each operation terminal 510 and each control terminal 512 send back the monitoring data as an electric current mode signal during the signal response period WT of the transmission signal Vs. The electric current mode signal is a signal transmitted by short-circuiting the signal line Ls using a suitable low impedance. Now refer back to FIG. 1.

If the transmission control unit 514 transmits data to the operation terminal 510 or the control terminal 512, the transmission control unit 514 will transmit to the signal line Ls a transmission signal Vs in which the mode data MD indicates a control mode and the address of either the operation terminal 510 or the control terminal 512 is the address data AD. The operation terminal 510 or the control terminal 512, whose address matches the address data AD, receives the control data CD and then sends back the monitoring data during the signal response period WT. The transmission control unit 514 checks that the control data CD have been transmitted to the desired terminal, which is the operation terminal 510 or the control terminal 512, based on the relationship between the control data CD transmitted and the monitoring data received during the signal response period WT. The control terminal 512 outputs a load control signal, which is used to control a load L according to the received control data CD, whereas the operation terminal 510 outputs a display signal, which is used to display an operation verification of the load L according to the received control data CD.

At normal times, namely while no data is transmitted, the transmission control unit 514 transmits a transmission signal Vs, in which the mode data MD is set to a dummy mode, at predetermined intervals. This is called a constant polling or normal polling. In this case, the transmission control unit 514 accesses one of the control terminals 512 and then requires the thus accessed control terminal 512 to send back the monitoring data indicative of the load status. The thus accessed control terminal 512 sends back the status of a load being connected thereto, to the transmission control unit 514 as the monitoring data. Upon receiving this response, the transmission control unit 514 accesses the address of the operation terminal 510 having a correspondence relation with the control terminal 512 and then transmits the control data CD, which is required to display the status of the load connected to the corresponding control terminal 512. As described above, the operation where the address of a control terminal 512 and the address of an operation terminal 510 having the correspondence relation with this control terminal 512 are accessed is repeated cyclically in the constant polling.

If, during the constant polling, the operation terminal 510 is to transmit certain information to the transmission control unit 514, an interrupt signal Vi will be generated such that the interrupt signal Vi is synchronized with the synchronization signal SY of the transmission signal Vs in the dummy mode. FIG. 2C shows an exemplary waveform of the interrupt signal Vi. The interrupt signal Vi is a pulsed signal. Now refer back to FIG. 1. The operation terminal 510 sets an interrupt flag and gets ready for the subsequent exchange of information with the transmission control unit 514. Upon receiving the interrupt signal Vi, the transmission control unit 514 transmits the transmission signal in a manner such that the mode data MD is set to an interrupt polling mode and such that the half of high-order bits of the address data AD (i.e., the higher-order 4 bits if the address AD is of 8 bits) is being sequentially increased. If, on the other hand, the higher-order 4 bits of the address data AD of the transmission signal in the interrupt polling mode matches the higher-order 4 bits of the address set in the operation terminal 510, the operation terminal 510 will send back the lower-order 4 bits of the address thereof to the transmission control unit 514 during the signal response period WT. In this manner, the transmission control unit 514 searches for an operation terminal 510, which has generated the interrupt signal Vi, for every group of sixteen operation terminals altogether, so that the operation terminal 510 can be found in a relatively short time.

As the transmission control unit 514 acquires the address of the operation terminal 510 that has generated the interrupt signal Vi, the transmission control unit 514 sets the mode data MD to a monitoring mode and transmits a transmission signal Vs having the thus acquired address data AD to the signal line Ls. In response to this transmission signal Vs, the operation terminal 510 sends back information, which the operation terminal 510 intends to transmit, during the signal response period WT. Finally, the transmission control unit 514 transmits a signal with which to instruct it to reset the interrupt, to the operation terminal 510 that has generated the interrupt signal Vi, and cancels the interrupt flag of the operation terminal 510. In this manner, the transmission of information from the operation terminal 510 to the transmission control unit 514 is completed when the transmission control unit 514 transmits signals four times to the operation terminal 510 (namely, transmits a dummy mode signal, an interrupt polling mode signal, a monitoring mode signal, and an interrupt reset signal thereto). In order for the transmission control unit 514 to acquire an operating status of a desired control terminal 512, it is only necessary that a transmission signal, to which a monitoring mode has been set, be transmitted thereto.

When any one of control switches is pressed, the operation terminal 510 sends back monitoring data, which contains information on an address set to the pressed control switch, to the transmission control unit 514. The transmission control unit 514 transmits a transmission signal Vs, which contains control data CD generated based on this monitoring data, to the control terminal 512. Then the control terminal 512 controls a load according to the control data CD contained in the transmission signal Vs transmitted from the transmission control unit 514. Also, the control terminal 512, which has controlled the load, sends back the monitoring data to the transmission control unit 514. Then the transmission control unit 514 generates a transmission signal Vs, which contains control data CD used to display an operating status, based on the monitoring data sent back from the control terminal 512, and transmits the thus generated transmission signal Vs to the operation terminal 510. Using this transmission signal Vs, the operation terminal 510 carries out a lighting on/off execution function for displaying the operating state of the load.

Figure 3:
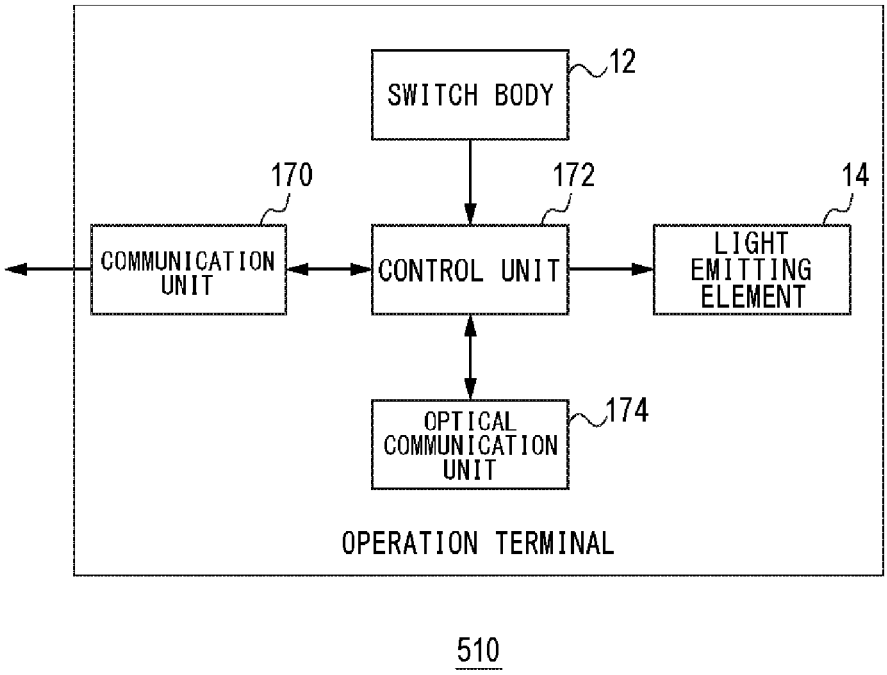
FIG. 3 shows a structure of an operation terminal shown in FIG. 1.

FIG. 3 shows a structure of an operation terminal 510. The operation terminal 510 includes a communication unit 170, a switch body 12, a light emitting element 14, a control unit 172, and an optical communication unit 174. The communication unit 170, which is connected to the signal line Ls, receives the transmission signal Vs and transmits the interrupt signal Vi and the monitoring data. The switch body 12, which is a push-button switch, constitutes the control switch. As described earlier, an addresses is set to each of the switch bodies 12. It is to be noted here that although a single switch body 12 is shown in FIG. 3, the operation terminal 510 may be provided with a plurality of switch bodies 12, which are, for example, four switch bodies 12.

The light emitting element 14, which is constituted by a light emitting diode, for example, displays the operating status of the load by a light emitting state. Although a single light emitting element 14 is shown in FIG. 3, a plurality of light emitting elements 14, which is, for example, two light emitting elements 14, may be provided for each switch body 12; in the above-described example, eight light emitting element 14 may be provided in total. The control unit 172 controls the communication unit 170 and each light emitting element 14, respectively, in response to the transmission signal Vs received by the communication unit 170 and operation inputs received by the switch bodies 12.

The optical communication unit 174 transmits and receives an optical signal, for which, for example, the infrared rays are used as a medium, to and from an address setting device (not shown) for setting an address of each switch body 12. The control unit 172 has memory (not shown) for storing the address of each switch body 12. When an optical signal indicative of the address of each switch body 12 is received by the optical communication unit 174, the control unit 172 rewrites the address of each switch body 12 stored in the aforementioned memory, according to the optical signal. In other words, the address of each switch body 12 is set in the control unit 172 by the optical signal sent to the optical communication unit 174.

This structure may be implemented hardwarewise by elements such as a CPU, memory and other LSIs of an arbitrary computer, and softwarewise by memory-loaded programs or the like. Depicted herein are functional blocks implemented by cooperation of hardware and software. Therefore, it will be obvious to those skilled in the art that the functional blocks may be implemented by a variety of manners including hardware only, software only or a combination of both.

Figure 4:
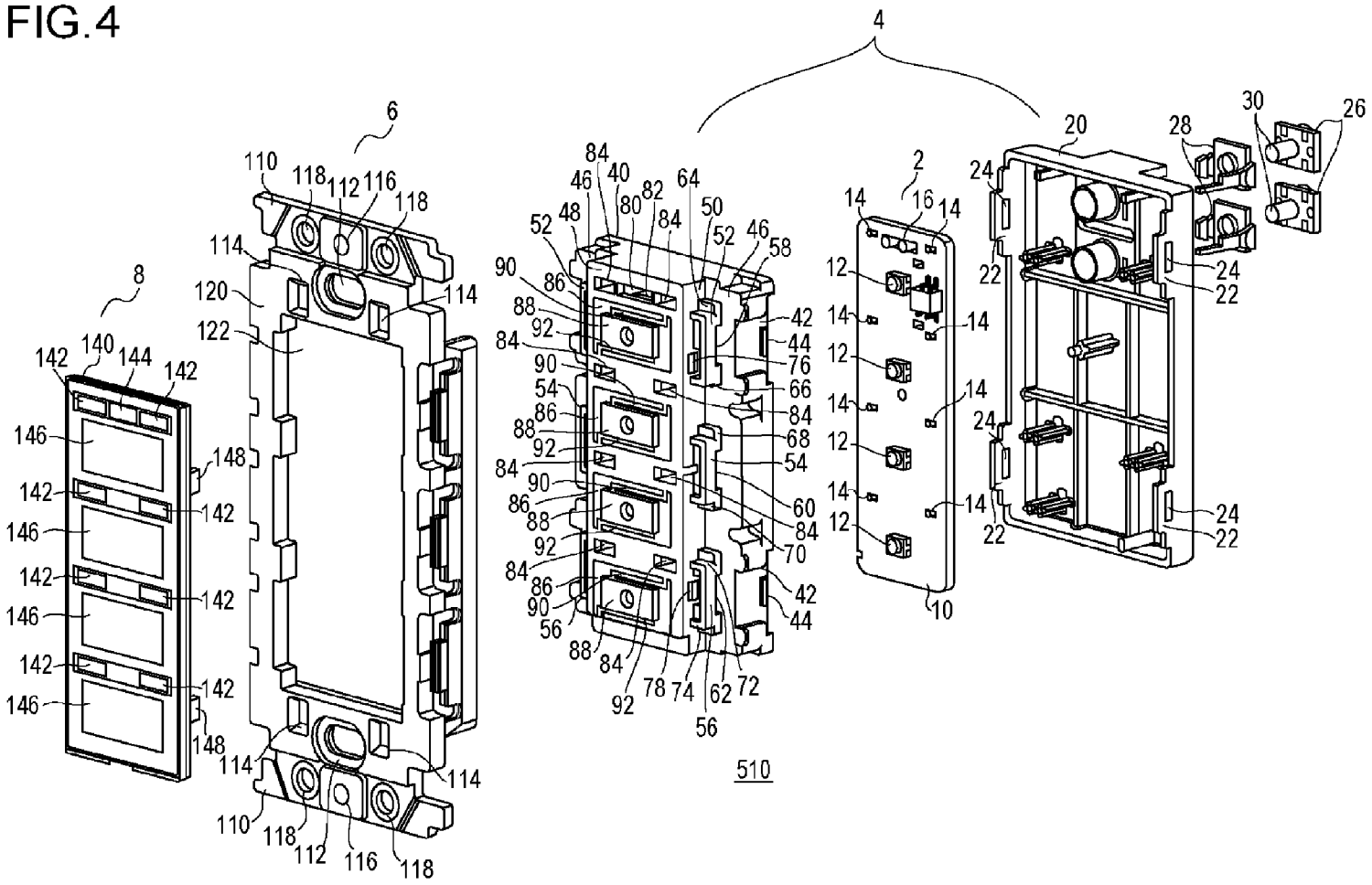
FIG. 4 is an exploded perspective view of an operation terminal shown in FIG. 1.
Figure 5:
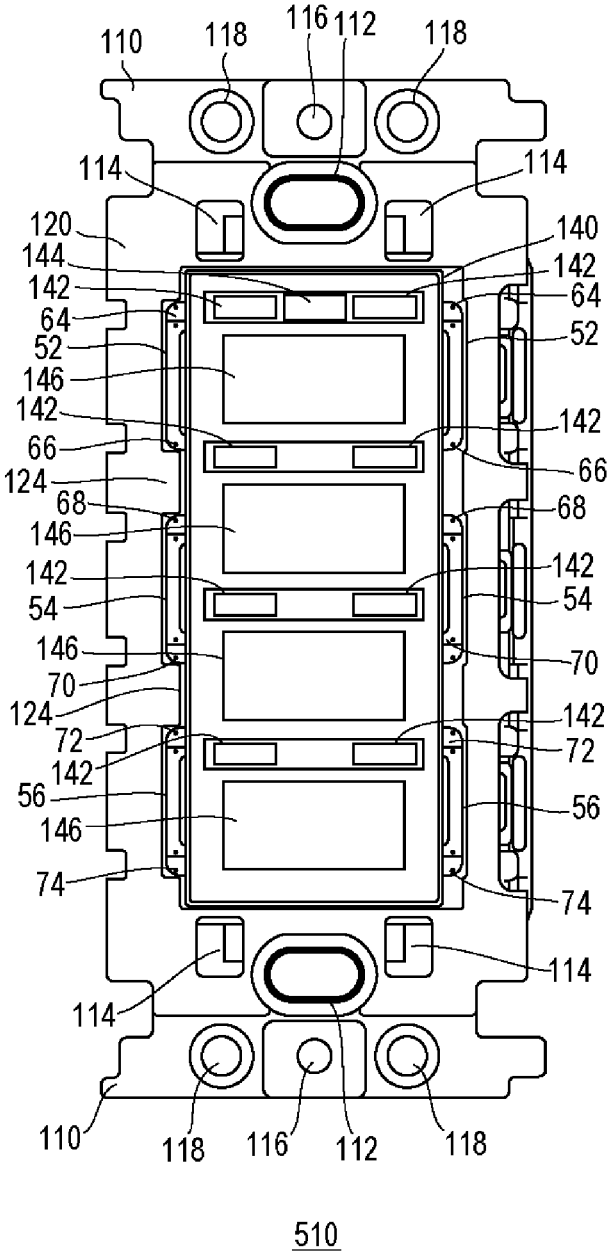
FIG. 5 is a front view of an operation terminal shown in FIG. 1.

FIG. 4 is an exploded perspective view of an operation terminal 510. Hereinafter, the up-and-down (vertical) direction is based on that shown in FIG. 4; the direction extending between upper-left and lower-right in FIG. 4 is called a left-and-right (horizontal) direction, and the direction extending between lower-left and upper-right in FIG. 4 is called a front-back direction. In other words, a decorative cover 8, a frame 6, a cover 40 for switches, a circuit block 2 and a body 20 are arranged side by side in this order starting from a front side. FIG. 5 is a front view of the operation terminal 510. FIG. 5 shows a case where the assembled operation terminal 510 is viewed from the front. Now refer back to FIG. 4.

The circuit block 2 is configured such that switch bodies 12, light emitting elements 14 and a light receiving-emitting unit 16 are mounted on a frontward side of a printed wiring board 10. Since the communication unit 170 and the control unit 172 can be realized by using a known art, the detailed illustrative depiction and the description thereof are omitted here. Also, the optical communication unit 174 can be realized by using a known art and therefore the detailed illustrative depiction and the description thereof are omitted here. The light receiving-emitting unit 16 included in the optical communication unit 174 is configured by the combination of a light emitting element for use in communications and a light receiving element. Here, this light emitting element transmits optical signals for which, for example, infrared rays are used as a medium, and this light receiving element converts an optical signal into an electrical signal. In the circuit block 2, the light receiving-emitting unit 16 is placed in a position above the four switch bodies 12.

The switch bodies 12 are linearly arranged along the vertical direction. Here, for each switch body 12, the two corresponding light emitting elements 14 are provided above the switch body 12 and are horizontally spaced apart from each other. The two light emitting elements 14 have mutually different light colors such that the light color thereof on the left side of the switch body 12 is green and the light color thereof on the right side thereof is red. During a period of time in which, for example, a load associated with the switch body 12 is being turned on, the not-shown control unit 172 turns on the right-side light emitting element 14 corresponding to this switch body 12 and turns off the left-side light emitting element 14 corresponding thereto. On the other hand, during a period of time in which the load associated with the switch body 12 is being turned off, the control unit 172 turns off the right-side light emitting element 14 corresponding to this switch body 12 and turns on the left-side light emitting element 14 corresponding thereto.

A housing 4 holds the printed wiring board 10 thereinside. The housing 4 is comprised of the rectangular parallelepiped shape body 20, having an opening in the front face thereof, and the cover 40 for switches, which is mechanically coupled to the body 20 in such a manner as to close the front opening of the body 20. The frame 6 is mountable on the cover 40 for switches. The body 20 and the cover 40 for switches are each formed of a synthetic resin molded product, for instance. On each of left and right walls of the body 20, the body 20 has connection pieces 22, which protrude frontward and are provided in positions vertically spaced apart from each other. Each connection piece 22 has a vertically-long connection hole 24, which runs through the connection piece 22. Also, on each of left and right lateral sides of the cover 40 for switches, the cover 40 for switches has connection grooves 42, which are formed in positions vertically spaced apart from each other. A vertically-long connection claw 44 protrudes outwardly in the horizontal direction on a bottom face of each connection groove 42. In such configuration and arrangement as described above, the connection piece 22 is inserted to each connection groove 42 and simultaneously the connection claw 44 is engageably inserted to the connection hole 24. Thereby, the body 20 and the cover 40 for switches are mechanically coupled together.

A pair of screw terminals 26 are held on an upper portion of a bottom face of the body 20, and one of the pair of signal lines Ls is connected to each screw terminal 26 from a rear side of the body 20. Further, an electric wire (not shown), one end of which has been connected to the communication unit 170, is connected to each screw terminal 26 from a front side of the body 20. In other words, the communication unit 170 is connected to the signal lines Ls via the electric wires and the screw terminals 26. Each screw terminal 26 is comprised of a terminal plate 28, which has a screw hole running therein and is fitted to the body 20, and a terminal screw 30 screwed into the screw hole of the terminal plate 28. A metallic washer, which holds the signal line Ls in between the metallic washer and the terminal plate 28, is formed integrally with the terminal screw 30.

Figure 6:
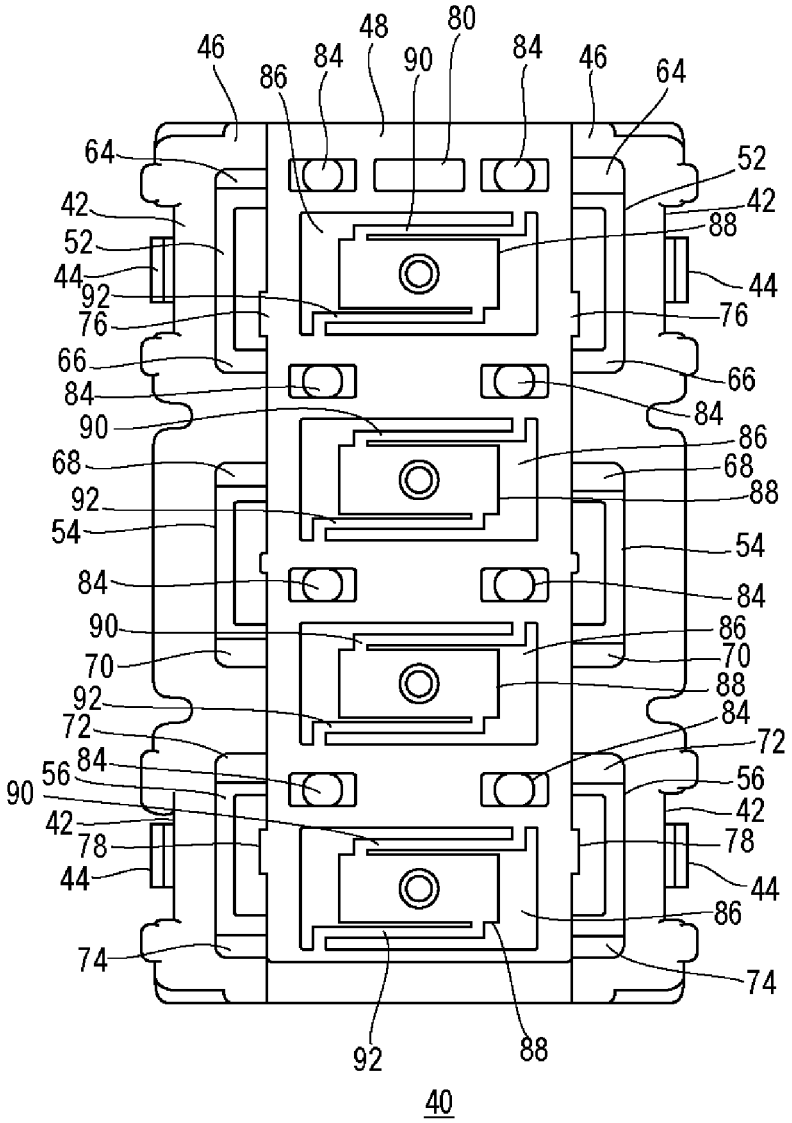
FIG. 6 is a front view of a cover for switch.
Figure 7:
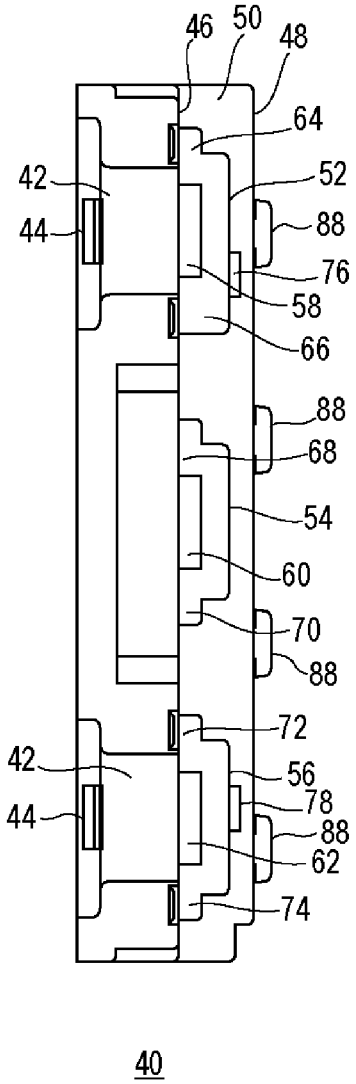
FIG. 7 is a side view of a cover for switch.

FIG. 6 and FIG. 7 in addition to FIG. 4 are used altogether for the purpose of explaining an outer shape of the cover 40 for switches. FIG. 6 is a front view of the cover 40 for switches, and FIG. 7 is a side view of the cover 40 for switches. Mounting surfaces 46 on which to mount the frame 6 are provided on both left and right sides of the cover 40 for switches, respectively. A protruding portion 48 is a portion positioned between the two mounting surfaces 46 in the cover 40 for switches and is provided in such a manner as to protrude frontward from the mounting surfaces 46. Accordingly, as viewed from above, the cover 40 for switches having the protruding portion 48 and the two mounting surfaces 46 is of an approximately protruding shape.

On each of the left and right mounting surfaces 46, a first wall part 52, a second wall part 54 and a third wall part 56 are provided upright along the vertical direction. In this arrangement, a surface on a protruding portion 48 side in the first wall part 52, the second wall part 54 and the third wall part 56 faces a protruding lateral face 50 of the protruding portion 48. Also, the lengths of the first wall part 52, the second wall part 54 and the third wall part 56 in the front-back direction are designed such that each length thereof is longer than one half of the length of the protruding lateral face 50 in the front-back direction.

A first hole 58 is formed on an opposite surface of the surface on a protruding portion 48 side in the first wall part 52. The first hole 58 has a vertically-long shape. A raised portion 124 or a projecting portion 126 (discussed later) provided in the frame 6 is inserted into the first hole 58 and thereby the raised portion 124 or the projecting portion 126 is fastened. Note that the raised portion 124 is inserted into the first hole 58 in the left-side first wall part 52 and that the projecting portion 126 is inserted into the first hole 58 in the right-side first wall part 52. A second hole 60 is similarly formed in the second wall part 54, and a third hole 62 is similarly formed in the third wall part 56. The first hole 58, the second hole 60 and the third hole 62 are each placed in alignment with the vertical positions of the raised portion 124 and the projecting portion 126 provided in the frame 6.

A first connection wall part 64 and a second connection wall part 66 are formed such that they extend from both ends of the first wall part 52 on the mounting surface 46. More specifically, the first connection wall part 64 is extended from an upper end of the first wall part 52 upward along the protruding lateral face 50; the second connection wall part 66 is extended from a lower end of the first wall part 52 downward along the protruding lateral face 50. The lengths of the first connection wall part 64 and the second connection wall part 66 in the front-back direction are designed such that each length thereof is less than or equal to one half of the length of the first wall part 52 in the front-back direction. A third connection wall part 68 and a fourth connection wall part 70 are similarly formed relative to the second wall part 54. Also, a fifth connection wall part 72 and a sixth connection wall part 74 are similarly formed relative to the third wall part 56.

A first raised claw 76 is provided, in an protruding manner, outwardly from the protruding lateral face 50 facing the first wall part 52. Further, as the cover 40 for switches is viewed from the front, the first raised claw 76 is surround by the first connection wall part 64, the first wall part 52 and the second connection wall part 66. As described above, the first raised claw 76 is located in a position lower than the center of the protruding lateral face 50, in a vertically-long space that is surrounded by the protruding lateral face 50, the first connection wall part 64, the first wall part 52 and the second connection wall part 66. Furthermore, the first raised claw 76 is arranged such that a part of the first raised claw 76 is exposed from a front-side edge of the first wall part 52, in a lateral face of the cover 40 for switches.

The first raised claw 76 is provided for the purpose of stopping and fastening the decorative cover 8 described later. More specifically, the first raised claw 76 stops and fastens an elastic piece 148, which is to be fastened and which is formed on the decorative cover 8. A fastening area, where the first raised claw 76 and the elastic piece 148 are fastened to each other, is surrounded by the first connection wall part 64, the first wall part 52 and the second connection wall part 66. Thus, the elastic piece 148 itself is stabilized or a damage to the elastic piece 148 is suppressed in the event that the fastening area is subjected to shock along horizontal and vertical directions. The first connection wall part 64, the first wall part 52 and the second connection wall part 66 protect the first raised claw 76 and the elastic piece 148, and also function to fasten the raised portion 124 or the projecting portion 126 (see FIG. 12) through the first hole 58. In this manner, the first connection wall part 64, the first wall part 52 and the second connection wall part 66 in combination have two functions and are efficiently arranged.

A second raised claw 78 is provided on the protruding lateral face 50 facing the third wall part 56. Differing from the first raised claw 76, however, the second raised claw 78 is located in a central part of the protruding lateral face 50, in a vertically-long space that is surrounded by the protruding lateral face 50, the fifth connection wall part 72, the third wall part 56 and the sixth connection wall part 74. Such a difference as this occurs because the first raised claw 76 and the second raised claw 78 are aligned to the positions where the elastic pieces 148 are arranged in the vertical direction of the decorative cover 8. Since only two elastic pieces 148 are vertically arranged, no raised claw is provided on the protruding lateral face 50 facing the second wall part 54.

Figure 8:
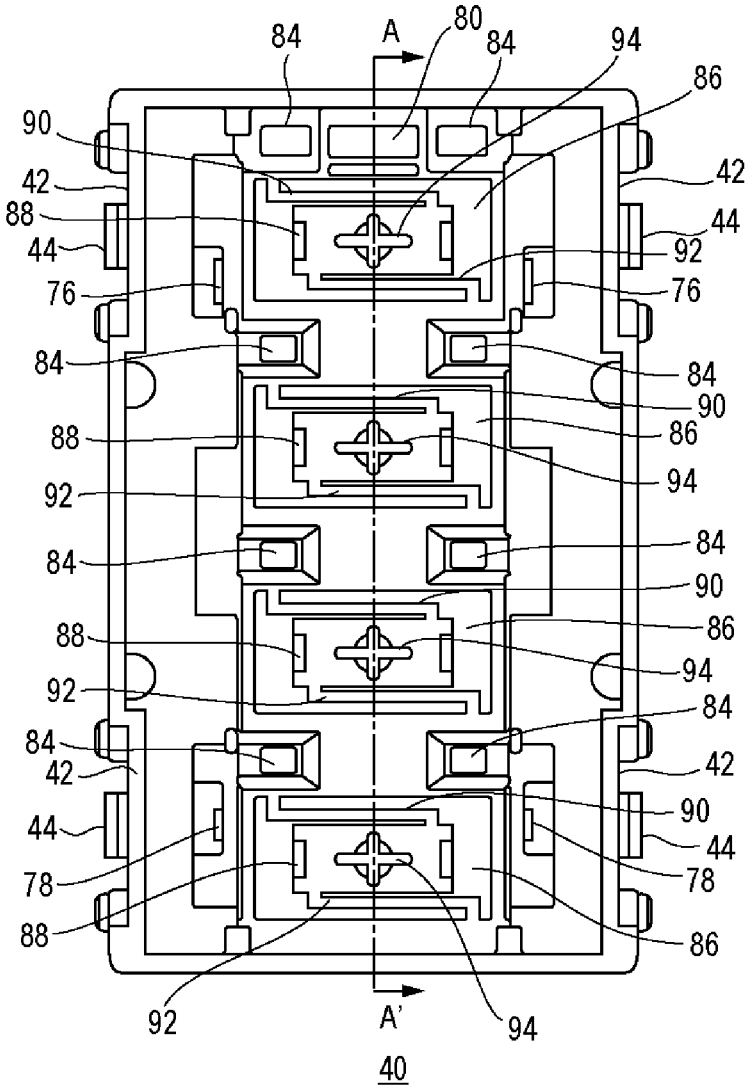
FIG. 8 is a rear view of a cover for switch.
Figure 9:
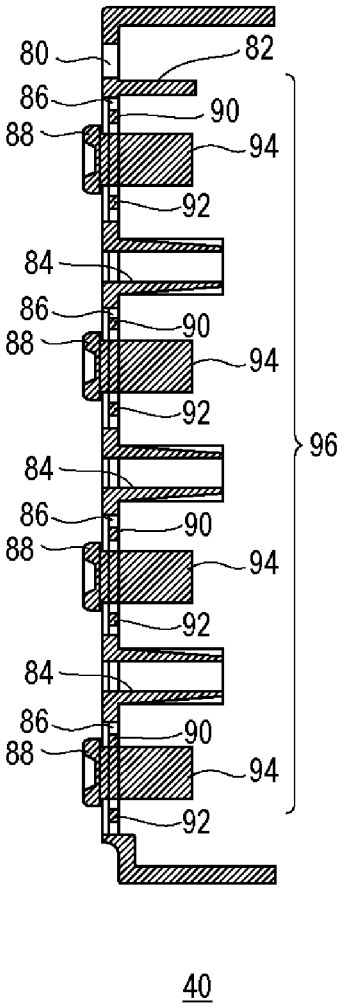
FIG. 9 is a cross-sectional view of a cover for switch.
Figure 10:
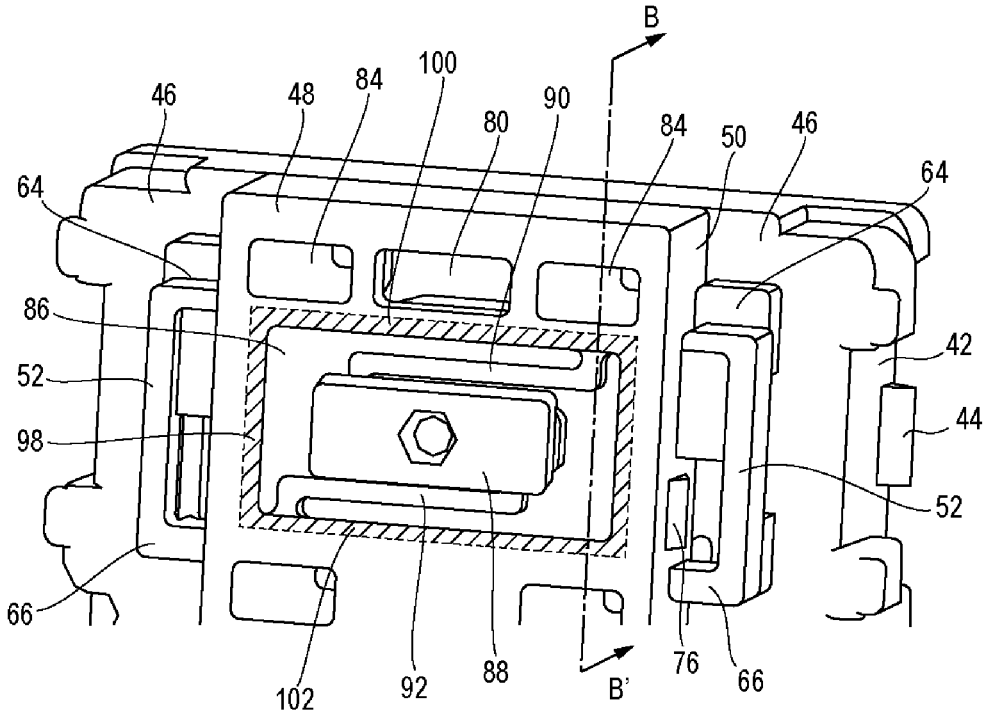
FIG. 10 is a perspective view showing a part of a cover for switch.

Four openings 86 are arranged vertically in the protruding portion 48. FIG. 8, FIG. 9 and FIG. 10 in addition to FIG. 4, FIG. 6 and FIG. 7 are now used altogether for the purpose of explaining a push-button handle 88 provided in the cover 40 for switches. FIG. 8 is a rear view of the cover 40 for switches. FIG. 9 is a cross-sectional view taken along the direction A-A' of FIG. 8. FIG. 10 is a perspective view showing a part of the cover 40 for switches. Since the four openings 86 and their vicinities share the same structure, a single opening 86 alone is shown in FIG. 10. The opening 86 is formed by an opening edge 98 provided in the protruding portion 48, and has a horizontally-long rectangular shape. The opening edge 98 has an inner circumference, which is identical to an outer circumference of the opening 86, and an outer circumference, which surrounds this inner circumference. Also, the opening edge 98 has an area held between the inner circumference and the outer circumference. For the clarity of explanation, the opening edge 98 is indicated by a shaded area in FIG. 10. Also, the opening edge 98 has an equivalent area to the shaded area shown in FIG. 10, on the back side of the cover 40 for switches, too. Further, the opening edge 98 has a lateral area held between the both areas thereof provided on the both sides of the protruding portion 48.

The push-button handle 88 is placed in each opening 86. Thus, the four push-button handles 88 are arranged vertically in the front face of the protruding portion 48. Since, as shown in FIG. 9, the four push-button handles 88 are generically referred to as "switch operation portion 96" or "switch operation portions 96", it may be alternatively stated that the switch operation portion 96 is provided in the front face of the protruding portion 48. The push-button handle 88 is formed of a material having elasticity such as a synthetic resin molded product. Each push-button handle 88 is of a horizontally-long rectangular shape as viewed from the front, and the front face thereof protrudes farther frontward than the protruding portion 48. The push-button handle 88 has a recess in the front face thereof. The recess is formed such that a horizontal central part of the push-button handle 88 in the front face is recessed farther rearward than both ends thereof in the horizontal direction.

Since, as described earlier, the opening 86 is formed into a rectangular shape, the opening edge 98 is formed by a combination of four vertical and horizontal rod-like areas. As illustrated in FIG. 10, an upper-side area of the four rod-like areas is defined to be a first edge 100, and a lower-side area thereof is defined to be a second edge 102. The first edge 100 and the second edge 102 are arranged opposite to each other. A first arm 90 extends from a lateral face of the first edge 100 and is coupled to the push-button handle 88. The first arm 90 has a crank shape. The crank shape is a shape resembling a crank, which is a mechanism by which to covert a liner movement to a rotational movement. The crank shape is, for example, a shape where one end of a straight line is bent in an almost perpendicular direction and the other end thereof is bent in another almost perpendicular direction. The crank shape does not just mean a particular single shape but it also includes a continuous curvature that is, for example, a smooth curvature such as an S-shaped form. Here, "being almost perpendicular" does not mean being strictly and exactly perpendicular but may be recognized to a degree that it is practically perpendicular.

Thus, the first arm 90 first extends downward almost perpendicularly staring from a position farther rightward than a right end of the push-button handle 88 in the first edge 100, then is bent almost perpendicularly in the horizontal direction, and extends in between the first edge 100 and an upper edge of the push-button handle 88 along with them. Further, the first arm 90 is almost perpendicularly bent downward in a position farther rightward than a left end of the push-button handle 88 and then reaches the upper edge of the push-button handle 88. In this manner, the first arm 90 takes a roundabout route (a longer path) starting from the first edge 100 up to the push-button handle 88 and thereby has a shape such that the length thereof is longer than the shortest distance between the upper edge of the push-button handle 88 and the first edge 100. As a result, the elasticity of the first arm 90 increases, thereby improving the operation feeling sensed when the push-button handle 88 is pressed.

A second arm 92 is provided between the second edge 102 and the push-button handle 88 and is placed in such a position that the second arm 92 is appropriately rotationally symmetric about an axis, which is also the center of a front face of the push-button handle 88. Being appropriately rotationally symmetric does not necessarily mean being strictly and exactly rotationally symmetric but may deviate from the exact symmetry of rotation within an allowable error range. Note that the first arm 90 and the second arm 92 may be each called a hinge. Further, the opening edge 98, the push-button handle 88, the first arm 90 and the second arm 92 are all formed integrally with each other.

Figure 11:
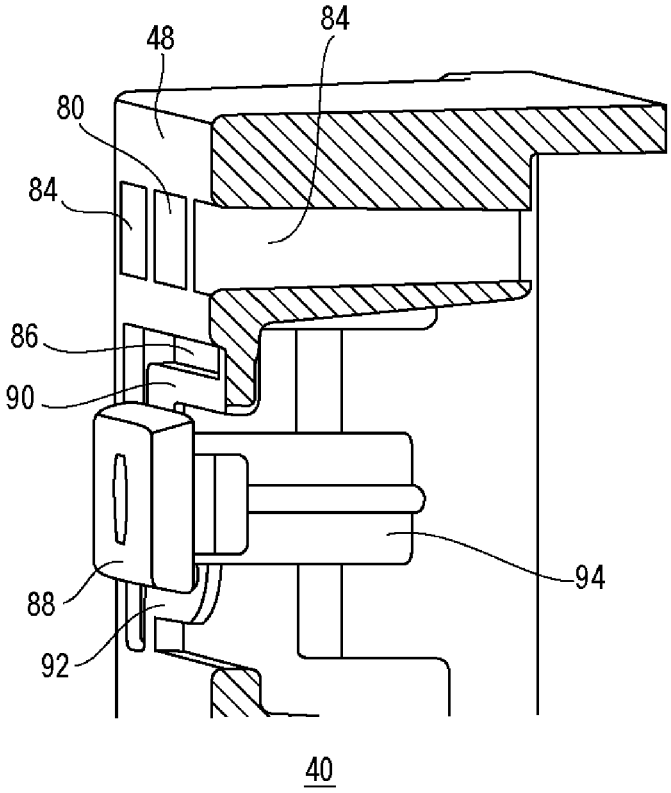
FIG. 11 is a cross-sectional view showing a part of a cover for switch.

The push-button handle 88 is positioned on the front side of the switch body 12 and transmits the pushing force, which is applied from a front side of the push-button handle 88, to the switch body 12. Thus, the push-button handles 88 correspond one-to-one to the switch bodies 12. FIG. 11 is now also used for the purpose of explaining the structure of the push-button handle 88 in more detail. FIG. 11 is a cross-sectional view, which shows a part of the cover 40 for switches, taken along the direction B-B' of FIG. 10. A pressing force part 94 is provided, in a protruding manner, from a central part of the rear face of the push-button handle 88 rearward, and is disposed counter to the switch body 12. The opening edge 98, the push-button handle 88, the first arm 90 and the second arm 92 are configured and arranged as described above. In this configuration and arrangement, when the front face of the push-button handle 88 is pressed, the first arm 90 and the second arm 92 are elastically deformed with the result that the push-button handle 88 is displaced rearward. In so doing, the elastic deformations in the first arm 90 and the second arm 92 are done almost evenly. This makes it easy for the push-button handle 88 to move rearward in a straight direction. This also improves the operation feeling.

A window hole 80 running through in the front-back direction is formed in a horizontal center at an upper end of the protruding portion 48. The window hole 80 has a horizontally-long rectangular shape. A signal partition wall 82 is protrudingly provided rearward on a periphery of a rearward opening of the window hole 80, and the light receiving-emitting unit 16 is located behind the signal partition wall 82. An optical signal enters the light receiving-emitting unit 16 through the window hole 80.

In the protruding portion 48, two first light guidance parts 84, which are horizontally arranged, are formed above each of the openings 86. The total of eight first light guidance parts 84 are arranged. In particular, two first light guidance parts 84 located in the uppermost of the eight first light guidance parts 84 are so arranged that the window hole 80 is located between the two first light guidance parts 84. Each of the first light guidance parts 84 corresponds one-to-one to the light emitting element 14, and the light emitting elements 14 are located behind the first light guidance parts 84. Light emitted from the light emitting element 14 is outputted frontward through the first light guidance part 84.

Figure 12:
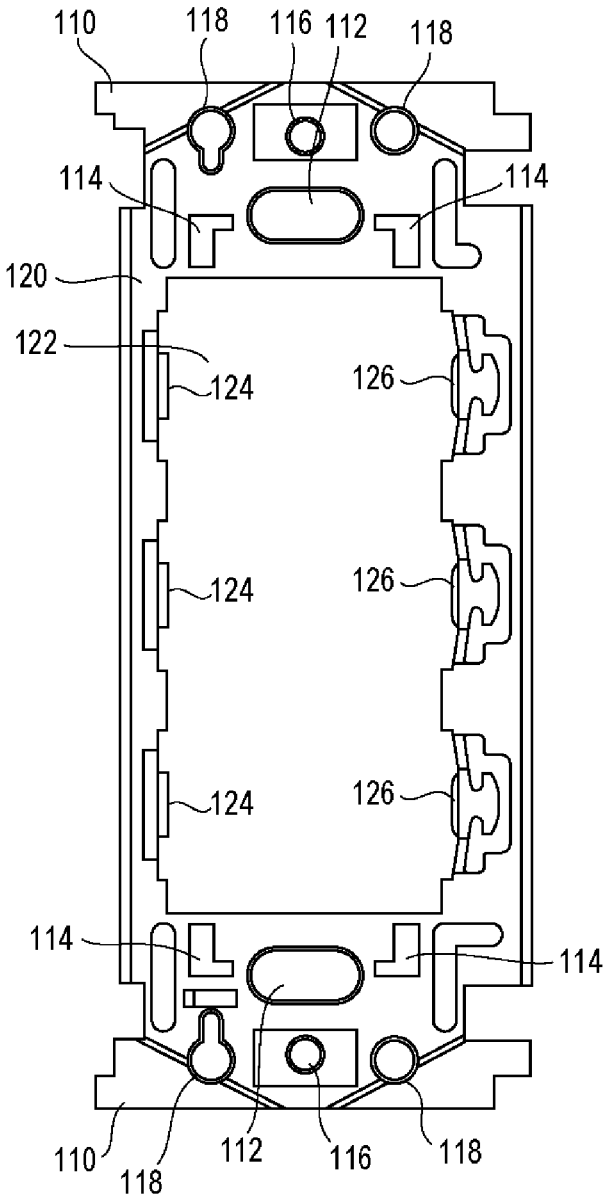
FIG. 12 is a front view of a frame.

The frame 6 is, for example, a mounting frame for "interchangeable wiring devices of large square boss type" regulated by JIS C 8375, and is made from metal. Note that the frame 6 may conform to other standards than JIS C 8375. FIG. 12 in addition to FIG. 4 are used altogether for the purpose of explaining a structure of the frame 6. FIG. 12 is a front view of the frame 6. Mounting portions 110 are used to secure the housing 4 to a formation surface (not shown), such as a wall surface. The mounting portions 110 are provided, at both upper and lower ends of the frame 6, such that each mounting portion 110 vertically protrudes outward from the body 20. A box hole 112, through which a box screw, which is screwed into an embedded box (not shown) embedded in the formation surface, is inserted, is formed in a center of each of the mounting portions 110. The box hole 112 is of a horizontally-long long-hole shape.

Also, hooking holes 114 are formed on both left and right sides of the box hole 112 in each mounting portion 110. Here, the hooking hole 114 is used to hook and fasten a clipping attachment (not shown) by which a panel is held between the mounting portion 110 and the clipping attachment, when the formation surface is formed by the panel. Further, plate holes 116, through which screws used to mount plates (not shown) are inserted, are formed in positions vertically outside the box holes 112, respectively, in the mounting portions 110. Furthermore, direct-mounting holes 118, through which direct-mounting screws screwed into the formation surface are inserted, are formed on both left and right sides of the plate hole 116 in each mounting portion 110.

A frame body 120 is positioned in between the two mounting portions 110 provided at both upper and lower ends of the frame 6. The frame body 120, which is of a vertically-long long rectangular shape, and has an opening 122 in a central part thereof. The opening 122 is formed in a size such that the protruding portion 48, the first wall part 52, the second wall part 54, the third wall part 56, the first connection wall part 64, the second connection wall part 66, the third connection wall part 68, the fourth connection wall part 70, the fifth connection wall part 72 and the sixth connection wall part 74 can be inserted from the rear side of the opening 122. When the protruding portion 48 and so forth are inserted into the opening 122, the frame body 120 is placed on the mounting surface 46.

The raised portions 124 are protrudingly provided on a left-side lateral face of the opening 122 such that three of the raised portions 124 are vertically separated away from each other. When the protruding portion 48 and so forth are inserted into the opening 122, the three raised portions 124 are inserted into the first hole 58, the second hole 60 and the third hole 62, which are formed on the left side of the cover 40 for switches, and thereby these raised portions 124 are fastened through the first hole 58, the second hole 60 and the third hole 62.

The projecting portions 126 are protrudingly provided on a right-side lateral face of the opening 122 such that three of the projecting portions 126 are vertically separated away from each other. In particular, the projecting portions 126 and the raised portions 124 are placed in positions facing each other in a one-to-one correspondence relation. In the case of FIG. 12, the projecting portion 126 does not protrude leftward from the right-side lateral face of the opening 122. In this state, the protruding portion 48 and so forth are inserted into the opening 122. As the right-side part of each projecting portion 126 is pushed leftward after the protruding portion 48 and so forth have been inserted into the opening 122, the left-side part of each projecting portion 126 protrudes leftward. As the projecting portions 126 protrude, the three projecting portions 126 are inserted into the first hole 58, the second hole 60 and the third hole 62, which are formed on the right side of the cover 40 for switches. Thereby, the three projecting portions 126 are fastened through the first hole 58, the second hole 60 and the third hole 62.

In a front side of the housing 4, a rectangular-shaped decorative cover 8 is mounted detachably (i.e., in a removably attachable manner). The decorative cover 8 vertically covers up to below and above the box holes 112 as viewed from the front. In order to cover the switch operation portion 96, the decorative cover 8 is comprised of a cover body 140, which is made to adhere to a front side of the cover 40 for switches, and the four elastic pieces 148 extending rearward and perpendicularly from the cover body 140. The elastic piece 148 is a portion to be fastened or stopped (locked in place), as described earlier, and are arranged on both left and right sides of the cover body 140 such that the two elastic pieces 148 are vertically separated away from each other. The elastic piece 148 is formed of a synthetic resin molded product, for instance.

A second light guidance part 142 is formed in a part of the cover body 140, in a front side of the first light guidance part 84. The second light guidance parts 142 correspond one-to-one to the first light guidance parts 84. Thus, the second light guidance parts 142 are arranged such that the total four sets of rows thereof, each of which is composed of a pair of second light guidance parts 142 horizontally placed, are vertically arranged in a column. The light emitted from the light emitting element 14 is outputted frontward through the second light guidance part 142. A signal window 144, which is provided in a horizontally central part at an upper end of the cover body 140, is in a front-side position of the window hole 80. The setting of addresses by the address setting device is performed such that an optical communication unit (not shown) of the address setting device is pressed against the signal window 144.

In order to cover the push-button handle 88, a membrane 146 in the cover body 140 is provided in a front-side position of the push-button handle 88. Four membranes 146 are vertically provided in four rows. With this configuration and arrangement, the pressing operation of the push-button handle 88 is carried out by way of the membrane 146.

Figure 13:
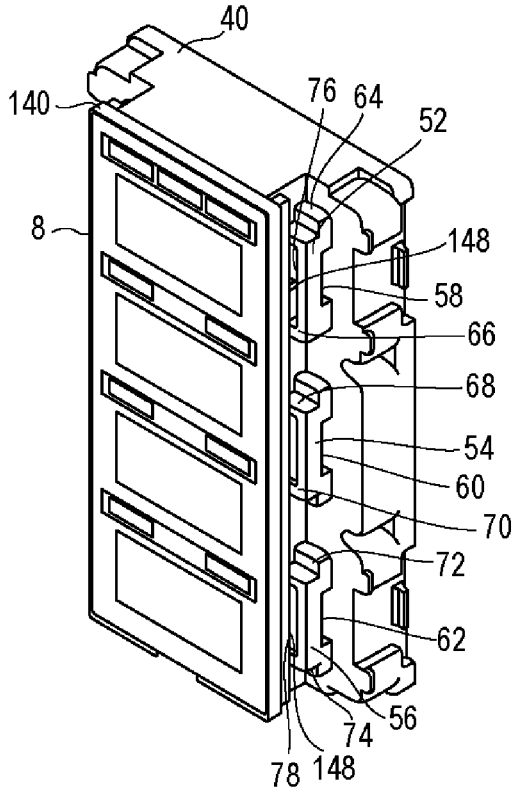
FIG. 13 is a perspective view showing a state where a decorative cover is mounted to a cover for switch.

FIG. 13 is a perspective view showing a state where the decorative cover 8 is mounted to the cover 40 for switches The decorative cover 8, which is positioned in a frontward direction of the cover 40 for switches, is now moved close to the cover 40 for switches. The elastic pieces 148 extending perpendicularly from the rear side of the cover body 140 are inserted into a recess, which is surrounded by the first connection wall part 64, the first wall part 52 and the second connection wall part 66, and a recess, which is surrounded by the fifth connection wall part 72, the third wall part 56 and the sixth connection wall part 74. After having been inserted into the recesses, the elastic pieces 148 are stopped and fastened by the first raised claw 76 and the second raised claw 78. Thereby, the front face of the cover 40 for switches is covered with the decorative cover 8.

Figure 14:
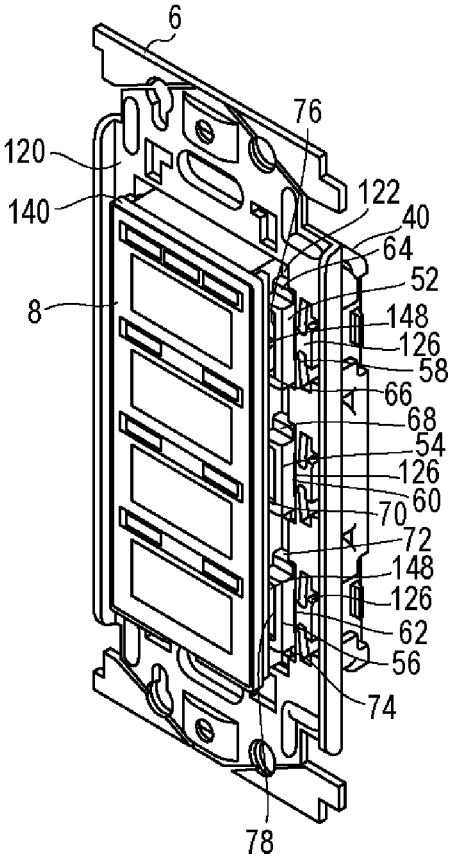
FIG. 14 is a perspective view showing a state where a decorative cover and a frame are mounted to a cover for switch.

FIG. 14 is a perspective view showing a state where the decorative cover 8 and the frame 6 are mounted to the cover 40 for switches. As illustrated in FIG. 13, the cover 40, for switch, to which the decorative cover 8 has been fastened, is inserted into the opening 122, which is formed in the frame 6, from the rear side of the frame 6. In so doing, the raised portions 124 (not shown), which are protrudingly provided in the frame 6, are fastened through the first hole 58, the second hole 60 and the third hole 62 (all of which are not shown), which are located on the left-side of the cover 40 for switches. As a result, the frame 6 and the cover 40 for switches are placed one upon another. Subsequent to this, the projecting portions 126, which are protrudingly provided in the frame 6, are fastened through the first hole 58, the second hole 60 and the third hole 62, which are located on the right-side of the cover 40 for switches. As illustrated in FIG. 14, when the projecting portions 126, which are provided in the frame 6, are inserted into the first hole 58 and the third hole 62, the first raised claw 76 and the second raised claw 78 are each provided in a position shifted from the projecting portion 126 as the cover 40 for switches is viewed from the front thereof. In other words, the first hole 58 and the third hole 62, which are vertically placed, are arranged in the positions where the first hole 58 and the third hole 62 do not interfere with the projecting portions 126.

By employing the present embodiment of the disclosure, the cover for switches and the push-button handle are coupled together using the two arms even when the cover for switches and the push-button handle are formed integrally with each other. Thus, the push-button handle can be easily pressed in a straight direction. Since the push-button handle is easily pushed in a straight direction, the operation feeling of the push-button handle can be improved. Also, the two arms are extended from the edges disposed counter to each other. Thus, the forces exerted on the two arms, respectively, when the push-button is pressed down, can be distributed almost evenly. Since the forces acting on the two arms, respectively, are distributed almost evenly, the push-button handle can be pressed down in a well-balanced manner. Since the push-button handle, the opening edge and the two arms are formed integrally with each other, the assembly time or the number of assembling processes can be reduced. Since the push-button handle, the opening edge and the two arms are formed integrally with each other, the assembly cost can be reduced.

The two arms each has such a shape that the arm takes a roundabout route (longer path) starting from the edge up to the push-button handle. Thus, the length of each arm can be made longer than the shortest distance between the edge and the push-button handle 88. Since the length of each arm is longer, the pressing width of the push-button handle can be increased. Since the pressing width of the push-button handle is increased, the operation feeling of the push-button handle can be improved. Since the two arms each has a crank shape, the length of the arm can be efficiently made longer. Since the length of the arm is efficiently longer, the area occupied by the push-button handle in the opening can be made larger. Since the area occupied by the push-button handle in the opening is larger, the push-button handle can be easily pressed.

Since the holes are formed in the wall parts, the frame can be fastened through the holes. Since the wall parts cover the first raised claw and the second raised claw, the decorative cover, which is fastened to the first raised claw and the second raised claw, can be protected by the wall parts. Since the wall parts are used to fasten the frame and protect the decorative cover, the wall parts can be given two different roles to play.

Since the wall parts have two different roles to play, components in the cover for switches can be efficiently arranged. Also, the increase in the size can be suppressed while the damage to the mounting parts of the frame and the decorative cover is prevented. Also, both the damage protecting function and the efficient arrangement can be simultaneously achieved. Since the holes are placed in alignment with the raised portions and the projecting portions of an all-purpose metal frame, a readily-available all-purpose metal frame can be used. Since the all-purpose metal frame is used, the strength of the frame can be increased. Since the all-purpose metal frame is used, the increase in the manufacturing cost can be suppressed.

Since the first raised claw and the second raised claw are surrounded by the connection wall parts, the cover for switches can be protected against shock applied along the vertical direction. Since the first raised claw and the second raised claw fasten the elastic pieces, a readily-available all-purpose decorative cover can be used. Since the all-purpose decorative cover is used, the increase in the manufacturing cost can be suppressed. Also, the first raised claw and the second raised claw are each provided in a position shifted from the projecting portion as the cover for switches is viewed from the front thereof. Thus, the thickness of the cover for switches can be made thinner.

Second Exemplary Embodiment

Similar to the first exemplary embodiment, the second exemplary embodiment relates to a cover for switches of an operation terminal included in a remote monitoring control system. The second exemplary embodiment differs from the first exemplary embodiment in that the shape of the two arms differ. A description is given here centering around the difference from the first exemplary embodiment.

Figure 15:
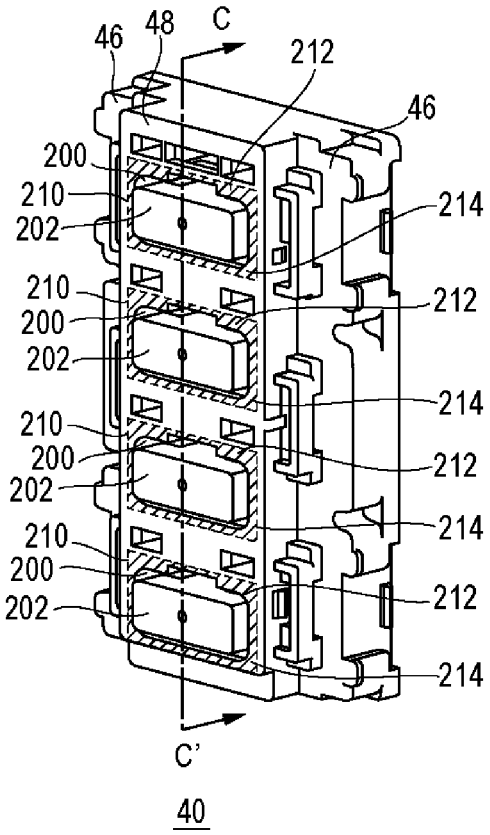
FIG. 15 is a perspective view of a cover for switch, according to a second exemplary embodiment of the disclosure.

FIG. 15 is a perspective view of a cover 40, for switch, according to the second exemplary embodiment of the disclosure. FIG. 15 is illustrated in such a manner as to be comparable to FIG. 4 and FIG. 10 in the first exemplary embodiment. The components of FIG. 15, where the same reference numerals are given as those of FIG. 4 and FIG. 10, have the same shapes and functions corresponding to those of FIG. 4 and FIG. 10. Of the components shown in FIG. 15, the reference numerals may not be assigned at all if such components thereof are identical to those shown in FIG. 4 and FIG. 10. An opening 200 is formed by an opening edge 210 provided in the protruding portion 48, and has a horizontally-long rectangular shape. The shape of the opening edge 210 is similar to that of the opening edge 98 and therefore the repeated explanation is omitted here. For the clarity of explanation, the opening edge 210 is indicated by a shaded area in FIG. 15, too, similarly to FIG. 10.

Figure 16:
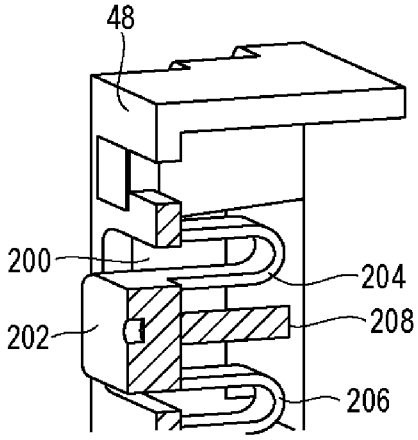
FIG. 16 is a cross-sectional view showing a part of the cover for switch shown in FIG. 15.

A push-button handle 202 is placed in each opening 200. Thus, the four push-button handles 202 are arranged vertically in the front face of the protruding portion 48. The push-button handle 202 is configured similarly to the push-button handle 88 excepting how a first arm 204 and a second arm 206, described later, are connected. FIG. 16 is also used here for the purpose of explaining, in more detail, how the push-button handle 202, the first arm 204 and the second arm 206 are connected among them. FIG. 16 is a cross-sectional view, which shows a part of the cover 40 for switches, taken along the direction C-C' of FIG. 15. A pressing force part 208 is provided, in a protruding manner, from a central part of the rear face of the push-button handle 202 rearward, and is disposed counter to the switch body 12.

Among four vertical and horizontal rod-like areas that form the opening 200, an upper-side area of the four rod-like areas is defined to be a first edge 212, and a lower-side area thereof is defined to be a second edge 214. The first edge 212 and the second edge 214 are arranged opposite to each other. The first arm 204 extends from the rear face of the first edge 212 and is coupled to the push-button handle 202. The first arm 204 has a U-shape.

The first arm 204 first extends rearward from a horizontal central part of the first edge 212 and a rear face of the shaded area thereof in FIG. 15, then is curved in a semicircular arc shape, and finally extends frontward. Further, the first arm 204 reaches a rear face of the push-button handle 202. Similar to the first arm 90, the first arm 204 having such a shape takes a roundabout route (longer path) starting from the first edge 212 up to the push-button handle 202. Thereby, the first arm 204 has a shape such that the length thereof is longer than the shortest distance between the upper edge of the push-button handle 202 and the first edge 212.

The second arm 206 is provided between the second edge 214 and the push-button handle 202 and is placed in such a position that the second arm 206 is appropriately rotationally symmetric about an axis of the first arm 204, which is also the center of a front face of the push-button handle 202. In the second exemplary embodiment, too, the opening 200, the push-button handle 202, the first arm 204 and the second arm 206 are all formed integrally with each other.

By employing the second exemplary embodiment, the two arms have a shape extending in the pressing direction of the push-button handle, so that the width of each arm can be increased. Since the width of each arm is increased, the strength of the arm can be improved.

Third Exemplary Embodiment

Similar to the first and second exemplary embodiments, the third exemplary embodiment relates to a cover for switches of an operation terminal included in a remote monitoring control system. The cover for switches according to the first and second exemplary embodiments has two arms. On the other hand, the cover for switches according to the third exemplary embodiments has a single arm. As described in the first and second exemplary embodiments, the operability is improved by using the two arms. The third exemplary embodiment, however, achieves a structure still keeping the excellent operability even with a single arm used. A description is first given hereunder of a case where the operability is generally degraded when a single arm. Then, a description is given of the cover for switches, according to the third exemplary embodiment centering around the differences from the first and second exemplary embodiments.

Figure 17:
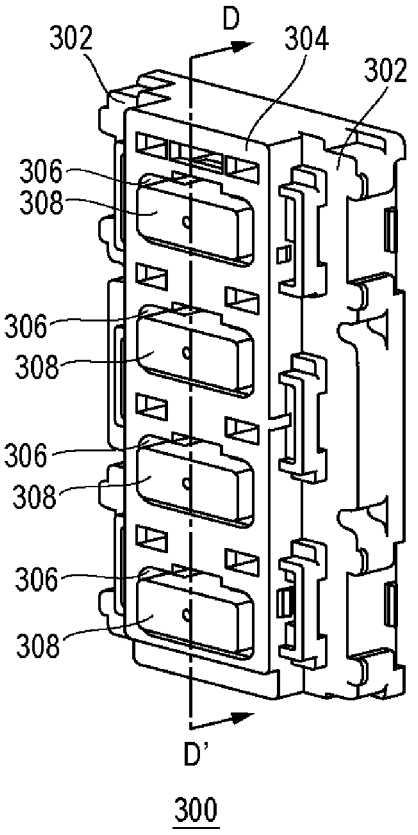
FIG. 17 is a perspective view of a cover for switch, which is a comparative example for a third exemplary embodiment of the disclosure.
Figure 18:
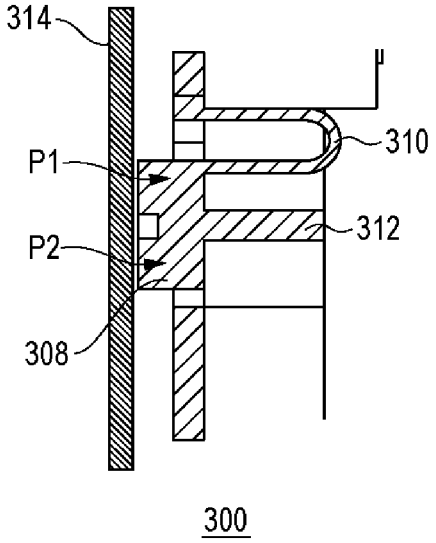
FIG. 18 is a cross-sectional view showing a part of the cover for switch shown in FIG. 17.

FIG. 17 is a perspective view of a cover 300 for switches, which is a comparative example for the third exemplary embodiment of the disclosure. Of the components shown in FIG. 17, the reference numerals may not be assigned at all, too, if such components thereof are identical to those shown in FIG. 4 and FIG. 10. FIG. 18 is a cross-sectional view, which shows a part of the cover 300 for switches, taken along the direction D-D' of FIG. 17. A mounting surface 302, a protruding portion 304 and a membrane 314 correspond respectively to the mounting surface 46, the protruding portion 48 and the membrane 146 in the first and second exemplary embodiments. Also, an opening 306, a push-button handle 308 and a pressing force part 312 correspond respectively to the opening 200, the push-button handle 202 and the pressing force part 208 in the second exemplary embodiment.

An arm 310 is provided on top of the push-button handle 308, and no arm is provided below the push-button handle 308. Accordingly, the arm 310 corresponds to the first arm 204 in the second exemplary embodiment but the second arm 206 in the second exemplary embodiment is not provided in FIG. 17. In other words, the cover 300 for switches shown as a comparative technique is equivalent to a configuration where the two arms provided in the second exemplary embodiment is changed to a single arm.

In such configuration and arrangement, the push-button handle 308 is pressed from the front to the rear by way of the membrane 314 shown in FIG. 18. Point P1 is located near the arm 310. Thus, the presence of the arm 310 restricts the movement of the push-button handle 308 from the front to the rear at the point P1. On the other hand, point P2 is located farther away from the arm 310 than the point P1. Thus, the point P2 is less affected by the arm 310 than the point P1. Hence, the movement of the push-button handle 308 from the front to the rear at the point P2 is less restricted than that at the point P1. As a result, when the push-button handle 308 moves from the front to the rear, the rearward movement distance differs between at the point P1 and at the point P2. This causes the arm 310 to turn and thereby causes a corner of the push-button handle 308 at the point P1 to be deformed. As illustrated in FIG. 18, the membrane 314 is located in front of the point P1 and therefore the push-button handle 308 interferes with the membrane 314 at the point P1. This interference deteriorates the operation feeling of the push-button handle 308.

Figure 19:
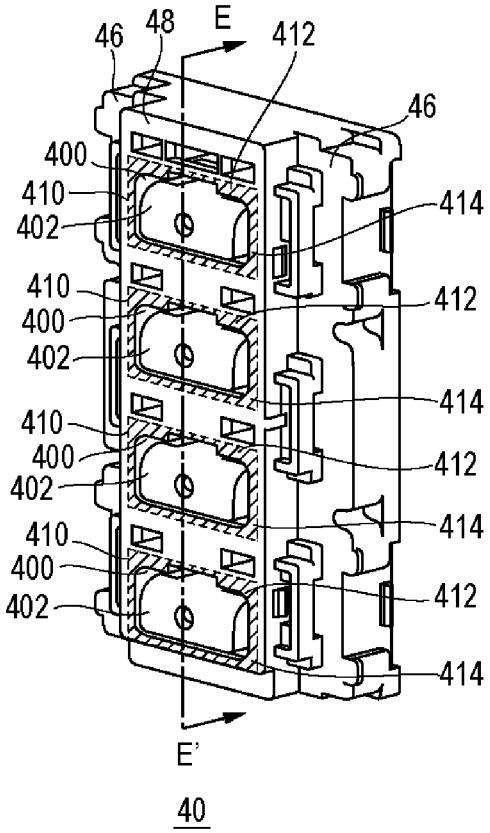
FIG. 19 is a perspective view of a cover for switch, according to a third exemplary embodiment of the disclosure.
Figure 20:
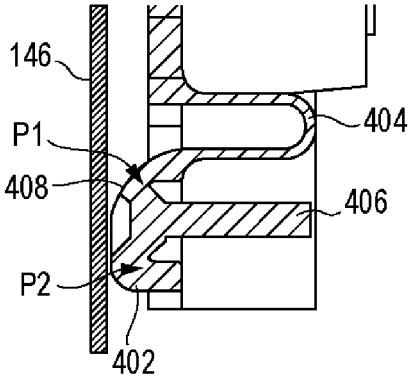
FIG. 20 is a cross-sectional view showing a part of the cover for switch shown in FIG. 19.

FIG. 19 is a perspective view of a cover 40, for switches, according to the third exemplary embodiment of the disclosure. FIG. 20 is a cross-sectional view, which shows a part of the cover 40 for switches, taken along the direction E-E' of FIG. 19. A description is given here by comparing the third exemplary embodiment with the comparative example shown in FIG. 17 and FIG. 18. An opening 400 is formed by an opening edge 410 provided in the protruding portion 48. Since the shape of the opening edge 410 is similar to those of the opening edge 98 and the opening edge 210, the repeated description thereof is omitted here. For the clarity of explanation, the opening edge 410 is indicated by a shaded area in FIG. 19, too.

A front face 408 of a push-button handle 402 has a linear shape in a lower-side part thereof in the cross-sectional view but has a curved shape in an upper-side part thereof. The curved shape is formed such that the front face 408 thereof is curved rearward as the position of the front face 408 moves toward an upward part thereof. As illustrated in FIG. 20, the membrane 146 for covering the front face 408 is provided. Thus, the front face 408 has a shape such that the closer the front face 408 approaches a position where the arm 404 is coupled to the push-button handle 402, the farther the front face 408 is located away from the membrane 146. Such components as the push-button handle 402, the opening edge 410 and the front face 408 are all formed integrally with each other, too.

In such configuration and arrangement, the push-button handle 402 is pressed from the front to the rear by way of the membrane 146 shown in FIG. 20, similarly to the comparative example. When the push-button handle 402 moves from the front to the rear, the rearward movement distance differs between at point P1 and at point P2. This may cause the arm 404 to turn and thereby may cause a corner of the push-button handle 402 at the point P1 to be displaced. However, the distance between the push-button handle 402 and the membrane 146 at the point P1 is longer than that in the comparative example. This reduces the interference between the push-button handle 402 and the membrane 146 at the point P1. The reduction in the interference therebetween improves the operation feeling of the push-button handle 402.

By employing the present exemplary embodiment of the disclosure, the closer the front face of the push-button handle approaches the position where the arm is coupled to the push-button handle, the farther the front face thereof is located away from the membrane. Thus, the single arm thus configured and arranged can reduce the interference between the membrane and the push-button handle when the push-button handle is pressed down. Since the interference between the membrane and the push-button handle is reduced, the operation feeling of the push-button handle can be improved. Also, since there is only a single arm, the manufacturing cost can be reduced.

The disclosure has been described based on the exemplary embodiments. The exemplary embodiments are intended to be illustrative only, and it is understood by those skilled in the art that various modifications to constituting elements or an arbitrary combination of each process could be further developed and that such modifications are also within the scope of the disclosure.

In the first to third exemplary embodiments of the disclosure, the directions specified or expressed therein are defined based on FIG. 4. However, this should not be considered as limiting and, for example, the directions may be defined arbitrarily as long as a relative positional relation is maintained. For example, "frontward" or the like used so far may be expressed "upward" or the like. In such a case, the "front side", "front face" or the like used so far will be expressed as "upper surface" or the like. According to this modification, the directions can be defined arbitrarily.

In the first to third exemplary embodiments of the disclosure, the operation terminal 510 is included in the remote monitoring control system 500. However, this should not be considered as limiting and, for example, the operation terminal 510 may not be included in the remote monitoring control system 500 but may be used as a switch for a normal electric lamp or the like. In such a case, the configuration of the circuit block 2 will be different but a known art may be used then. According to this modification, the range of application of the cover 40 for switches can be extended.

In the first to third exemplary embodiments of the disclosure, the first raised claw 76 and the second raised claw 78 are protrudingly provided on the protruding lateral face 50 for the purpose of fastening the elastic piece 148 of the decorative cover 8. However, this should not be considered as limiting and, for example, a stopper used to fasten the elastic piece 148 of the decorative cover 8 may be a hole formed in the protruding lateral face 50, instead of using the first raised claw 76 and the second raised claw 78 as the stoppers. Inserting the elastic piece 148 into the hole enables the decorative cover 8 to be fastened to the cover 40 for switches. According to this modification, the degree of freedom for design can be improved.

In the first to third exemplary embodiments of the disclosure, the opening 86, the opening 200 and the opening 400 each has a rectangular shape. Accordingly, the push-button handle 88, the push-button handle 202 and the push-button handle 402 each has a rectangular shape as well. However, this should not be considered as limiting and, for example, each of the openings and the push-button handles may have a shape other than the rectangular shape. Such a shape may be a circular shape, for instance. If the opening 86, the opening 200 and the opening 400 are of a circular shape, the first edge and the second edge, which are located opposite to each other, will be defined as regions including semicircular arcs that do not overlap with each other. According to this modification, push-button handles in various shapes can be used.

In the first to third exemplary embodiments of the disclosure, the number of the push-button handles 88, the number of the push-button handles 202 and the number of the push-button handles 402 are each "4". However, this should not be considered as limiting and, for example, the number of the push-button handles 88, the number of the push-button handles 202 and the number of the push-button handles 402 may each be other than "4" such as "3" or "5". According to this modification, the suitable or required numbers of the push-button handles 88, the push-button handles 202 and the push-button handles 402 can be mounted.

In the first to third exemplary embodiments of the disclosure, the first raised claw 76 and the second raised claw 78 are arranged such that a part of the first raised claw 76 and a part of the second raised claw 78 are exposed from the front-side edges of the first wall part 52 and the third wall part 56, respectively, in the lateral face of the cover 40 for switches. However, this should not be considered as limiting and, for example, the first raised claw 76 and the second raised claw 78 may be arranged such that the first raised claw 76 and the second raised claw 78 are entirely hidden behind the first wall part 52 and the third wall part 56, respectively, in the lateral face of the cover 40 for switches. According to this modification, the thickness of the mounting surface 46 can be made thinner.

In the first exemplary embodiment of the disclosure, the first arm 90 and the second arm 92 extend from the lateral faces of the first edge 100 and the second edge 102, respectively. However, this should not be considered as limiting and, for example, the first arm 90 and the second arm 92 may extend from the rear faces of the first edge 100 and the second edge 102, respectively. According to this modification, the degree of freedom for design can be improved.

In the first exemplary embodiment of the disclosure, the first arm 90 and the second arm 92 each has a crank shape. However, this should not be considered as limiting and, for example, the first arm 90 and the second arm 92 may have other shapes. The first arm 90 first extends downward almost perpendicularly staring from the position farther rightward than the right end of the push-button handle 88 in the first edge 100, then is bent almost perpendicularly in the horizontal direction, and extends in between the first edge 100 and the upper edge of the push-button handle 88 along with them. Also, the first arm 90 is bent downward almost perpendicularly at a position farther leftward than a left end of the push-button handle 88 and extends in between a left-side edge of the push-button handle 88 and a left edge of the push-button handle 88 along with them.

Further, the first arm 90 is almost perpendicularly bent leftward in a position farther upward than the left end of the push-button handle 88 and then reaches the left edge of the push-button handle 88. The second arm 92 is so provided as to correspond to the first arm 90. According to this modification, the lengths of the first arm 90 and the second arm 92 are further longer, the pressing width of the push-button handle can be increased.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A cover for switch, to which a frame is mountable, the cover comprising:

a mounting surface onto which the frame is to be mounted;

a protruding portion that protrudes from the mounting surface, the protruding portion having a switch operation portion in a front face thereof; and a wall part having a hole through which a projecting portion provided in the frame is inserted, the wall part being fixed upright on the mounting surface and a lateral surface of the protruding portion, wherein a stopper, which fastens a decorative cover for covering the switch operation portion on to the cover, is provided on the lateral surface of the protruding portion and is disposed in the hole of the wall part.

2. The cover for switch according to claim 1, wherein forming are a pair of connection wall parts extending from both ends of the wall part along the lateral face of the protruding portion, and wherein the stopper is surrounded by the wall part and the pair of the connection wall parts.

3. The cover for switch according to claim 1, wherein the stopper is a raised claw for fastening an elastic piece that is to be fastened, the elastic piece being formed on the decorative cover.

4. The cover for switch according to claim 2, wherein the stopper is a raised claw for fastening an elastic piece that is to be fastened, the elastic piece being formed on the decorative cover.

5. The cover for switch according to claim 1, wherein, when the projecting portion provided in the frame is inserted into the hole, the stopper is provided in a position shifted from the projecting portion as the cover for switch is viewed from a front thereof.

6. The cover for switch according to claim 2, wherein, when the projecting portion provided in the frame is inserted into the hole, the stopper is provided in a position shifted from the projecting portion as the cover for switch is viewed from a front thereof.

7. The cover for switch according to claim 3, wherein, when the projecting portion provided in the frame is inserted into the hole, the stopper is provided in a position shifted from the projecting portion as the cover for switch is viewed from a front thereof.

8. The cover for switch according to claim 4, wherein, when the projecting portion provided in the frame is inserted into the hole, the stopper is provided in a position shifted from the projecting portion as the cover for switch is viewed from a front thereof.

9. An operation terminal comprising:

a cover for switch according to claim 1; and a body coupled to the cover for switch, the body containing a printed wiring board where a switch body is packaged.

* * * * *